United States Patent [19]

Kimura

[11] 4,091,562

[45] May 30, 1978

[54] TOY RAILWAY SYSTEM

[75] Inventor: Chiyuki Kimura, Showa, Japan

[73] Assignee: Okuma Seisakusho Co. Ltd., Japan

[21] Appl. No.: 752,844

[22] Filed: Dec. 21, 1976

[30] Foreign Application Priority Data

Dec. 27, 1975 Japan ..... 50-177524[U]

[51] Int. Cl.[2] ..... A63H 19/18; A63H 30/06

[52] U.S. Cl. ..... 46/44; 46/216

[58] Field of Search ..... 46/44, 202, 206, 216; 273/86 B

[56] References Cited

U.S. PATENT DOCUMENTS

| | | | |
|---|---|---|---|
| 3,417,507 | 12/1968 | Ryan et al. | 46/202 |
| 3,418,750 | 12/1968 | Ryan et al. | 46/216 |
| 3,481,067 | 12/1969 | Cooper | 46/216 |
| 3,545,125 | 12/1970 | Okuma | 46/44 |
| 3,630,524 | 12/1971 | Cooper | 46/44 |

*Primary Examiner*—Louis G. Mancene
*Assistant Examiner*—Robert F. Cutting
*Attorney, Agent, or Firm*—Hans Berman

[57] ABSTRACT

In a toy railway system, a switch, a device for reversing the direction of movement of a toy train, and an uncoupling device on the track are each actuated by bellows in a pneumatic actuator assembly connected to manually expanded and contracted bellows in a bank of remote control devices by flexible hoses.

9 Claims, 16 Drawing Figures

TOY RAILWAY SYSTEM

This invention relates to a toy railway system in which the movement of toy vehicles on a track is remotely controlled, and particularly to a toy railway system in which the vehicle movement is modified by operating devices secured to respective rail sections of the track.

In its more specific aspects, the invention provides a toy railway system whose track includes a plurality of rail sections adapted to carry moving toy railway vehicles. Operating devices secured to respective rail sections permit the movement of such vehicles to be modified and are operatively connected to respective pneumatically operated actuating devices. Manually operable control devices are connected with respective operating devices by flexible tubular members. Each actuating device includes a pneumatic motor, and each control device includes manually operated means for supplying a gas under pressure to the associated pneumatic motor through the connecting tubular member.

A preferred embodiment of the invention is shown in the accompanying drawing in which.

Figure 1:
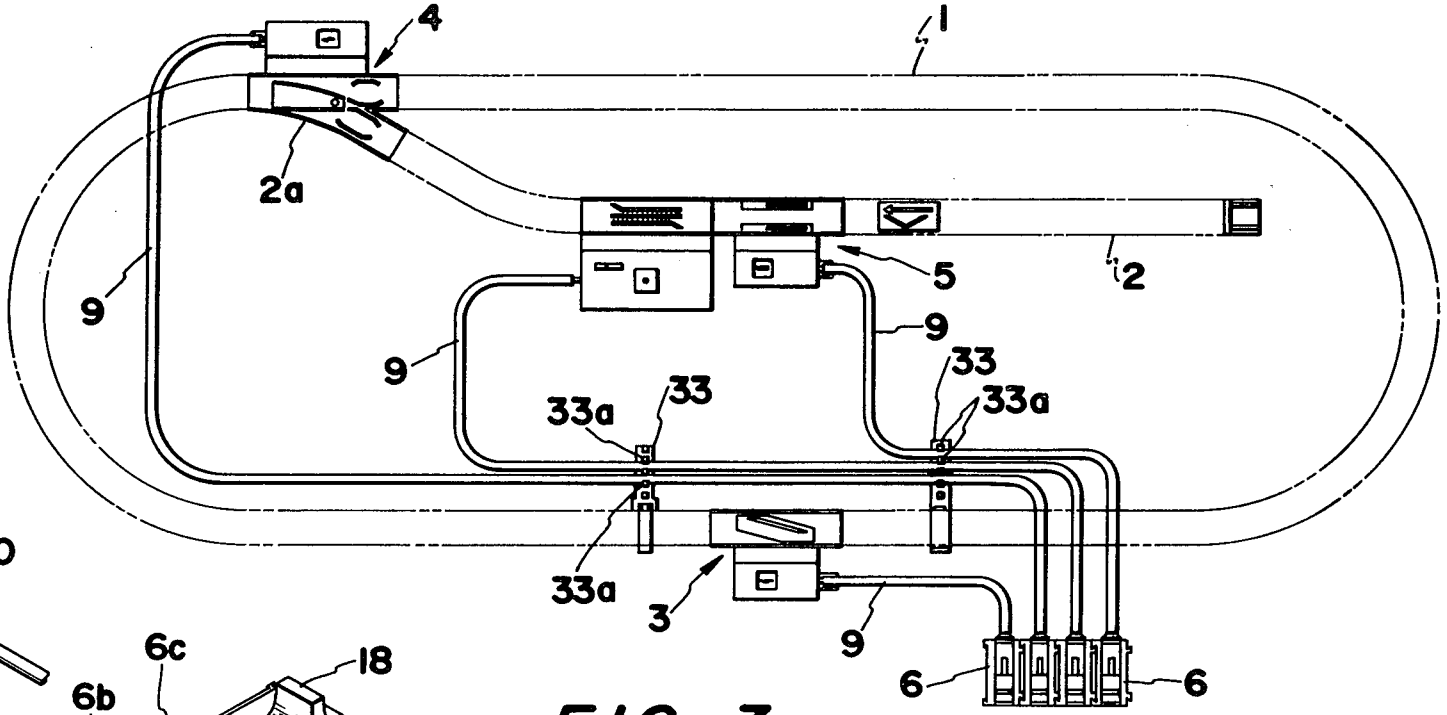
FIG. 1 shows the track and associated devices of a toy railway of the invention in top plan view.

Referring initially to FIG. 1, there are seen a main track 1 and a side track 2, each assembled from rail sections in a known manner, not shown, and connected by a switch 4. A reversing device 3 in the main track 1 permits the direction of a traveling train to be reversed. An uncoupling device 5 in the side track 2 permits the vehicles of a train to be uncoupled from each other. The actuators for the switch 4, reversing device 3, and uncoupling device 5 are controlled by respective manual control devices 6 spaced from the tracks 1, 2.

Figure 2:
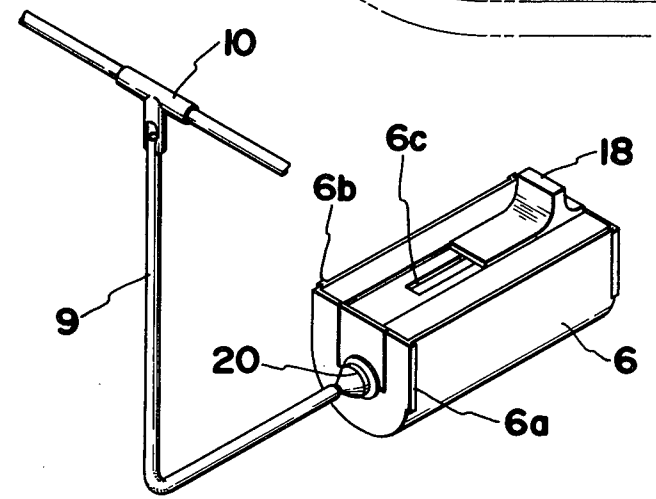
FIG. 2 illustrates a manual control device in the system of FIG. 1 in a perspective view.

As is better seen in FIG. 2, each control device 6 has ribs **6*a*, 6*b* by means of which the control devices can be assembled in a row as shown in FIG. 1. The structure common to the several actuators is shown in detail in FIGS. 4 to 6 and includes bellows 7 connected to bellows 8 in the associated control device 6 by a thin, flexible, rubber or plastic hose 9. A T-tube 10 in the hose 9 permits more than one actuator to be connected to the same control device 6**.

Figure 4:
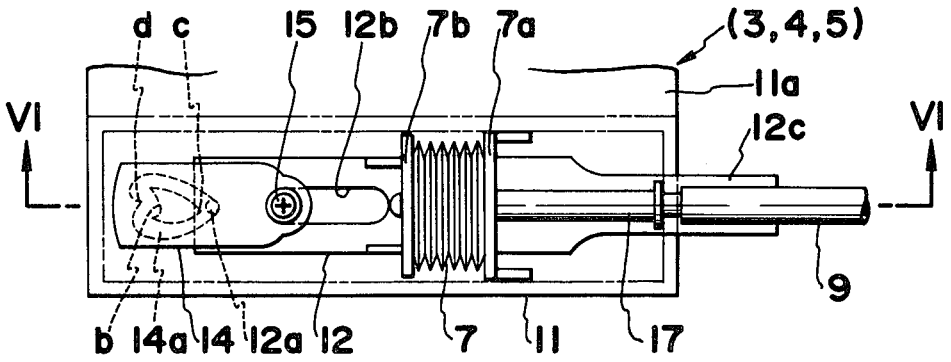
FIGS. 4 and 5 show an actuator assembly for operating devices of the track of FIG. 1 in two different positions in respective top plan views.
Figure 5:
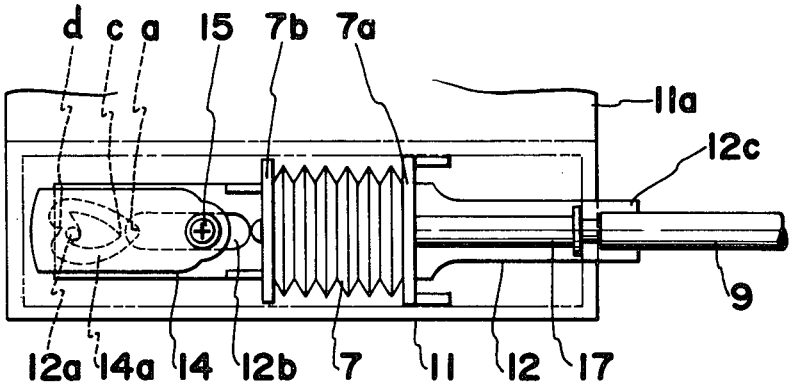
Figure 6:
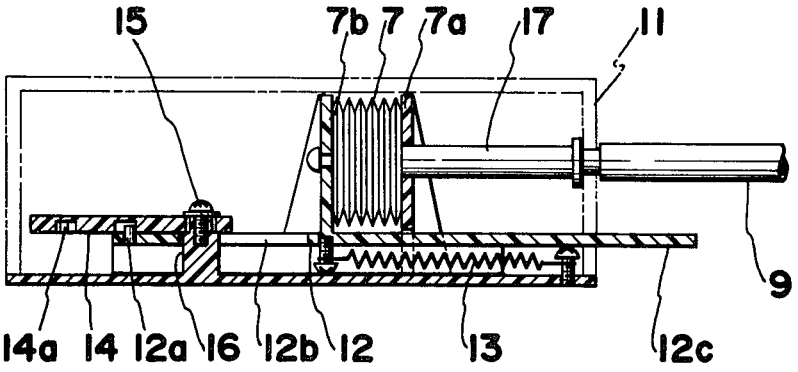
FIG. 6 shows the assembly of FIG. 4 in section on the line VI—VI.

As is shown in FIGS. 4 to 6, each actuator has a casing 11 integrally attached to a base plate **11*a* under a rail section of a track. One end plate 7*a* of the bellows 7 is fixedly fastened to the casing 11, and the other end plate 7*b* is attached to a slide 12 for moving the slide against the restraint of a helical tension spring 13 when the bellows 7 is expanded. A pin 12*a* projecting from the slide 12 is movably received in a cam groove 14*a* of a cam plate 14 mounted in the casing 11 for limited pivotal movement about a pin 15 on an integral projection 16 of the casing. The projection 16 is movably received in a straight slot 12*b* of the slide 12** for guiding the slide.

The cam groove **14*a* is heart-shaped. In the contracted position of the bellows 7 shown in FIGS. 4 and 6, the pin 12*a* is located at the point of the heart shape near the bellows 7** between a concave outer wall portion *a* of the groove **14*a*** and a convex inner wall portion *c* to arrest the slide 12 in one terminal position of its stroke. When the bellows 7 is expanded, the pin **12*a* travels along one of the two diverging branches of the groove 14*a*** toward the wide end of the heart shape and drops into a recess *b* in the inner groove wall under the action of the spring 13, when the air pressure in the bellows 7 is reduced, thereby arresting the slide 12 in its other terminal position. When the bellows 7 thereafter is inflated, the pin 15 moves out of the recess *b* and is deflected by a point *d* on the opposite outer wall of the groove **14*a* into one of the diverging branches to return to the position shown in FIGS. 4 and 6 when the bellows is deflated. The cam plate 14 pivots on the pin 15 during the rectilinear, reciprocating movement of the slide 12 caused by alternating inflation and deflation of the bellows 7. A portion 12*c* of the slide 12 projects outward of the casing 11 and permits the slide to be moved manually. A coupling tube 17 attached to the end plate 7*a* and secured to the casing 11 connects the bellows 7 to the associated hose 9**.

Figure 3:
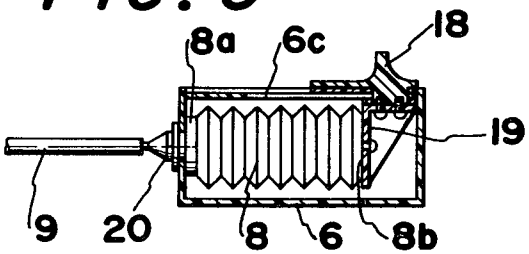
FIG. 3 is a side-elevational, sectional view of the device of FIG. 2.

As is shown in FIGS. 2 and 3, a slot **6*c* in the housing of each control device 6 slidably receives a manually operable knob 18 to which a pressure plate 19 is attached in the housing. One end 8*b* of the bellows 8 is attached to the plate 19 while the other end 8*a* is secured to a connector 20 passing outward of the housing and communicating with the associated hose 9**.

Figure 10:
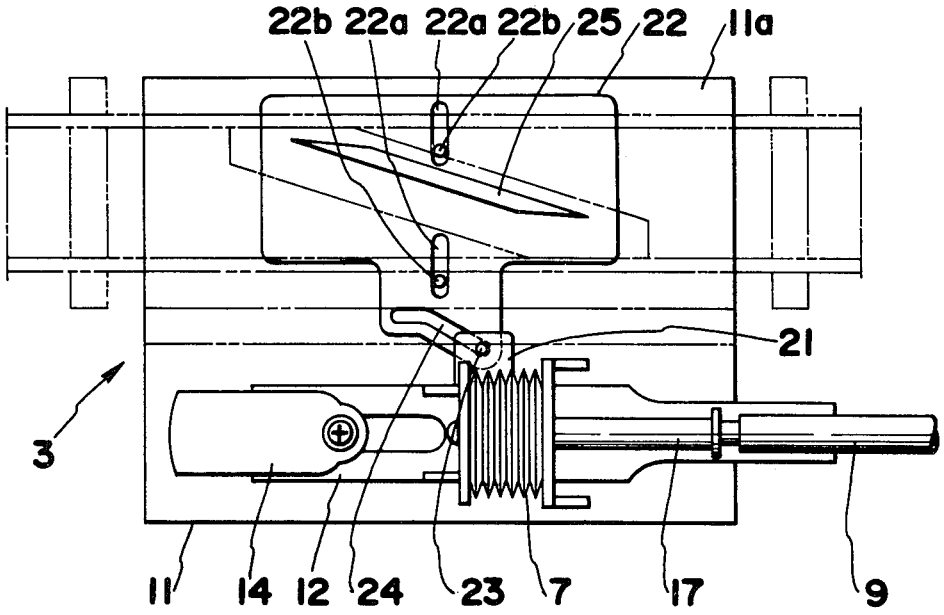
FIGS. 10 and 11 are top plan views of a reversing device on the track of FIG. 1 for the locomotive of FIGS. 7 - 9 in two different operating conditions.
Figure 11:
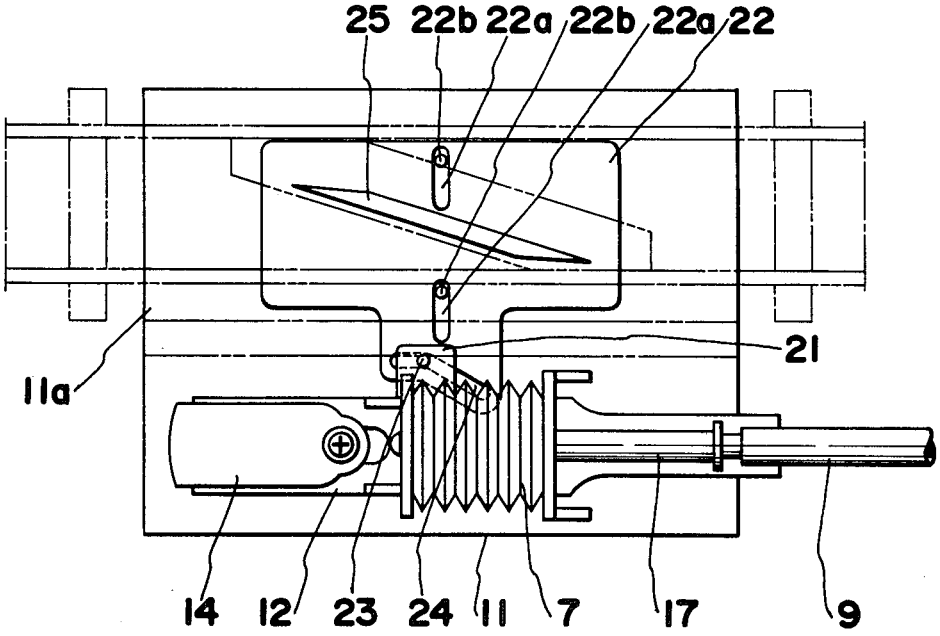

The reversing device 3 is seen in greater detail in FIGS. 10 and 11. Its actuator is provided with an arm 21 attached to the slide 12 and coupled by a pin 23 to a plate 22. The plate 22 is arranged between the base plate **11*a* and the associated rails of the track 1 and is guided perpendicularly to the rails by two pins 22*b* projecting from the base 11*a* into slots 22*a* of the plate 22. The pin 23 is movably received in a slot 24 of the plate 22 which is obliquely inclined relative to the rails. When the slide 12 is moved parallel to the rails by the expanding and contracting bellows 7, the plate 22 moves at right angles to the rails, and so does a rib 25 which projects upward from the plate 22. The rib 25** is obliquely inclined relative to the rails.

Figure 7:
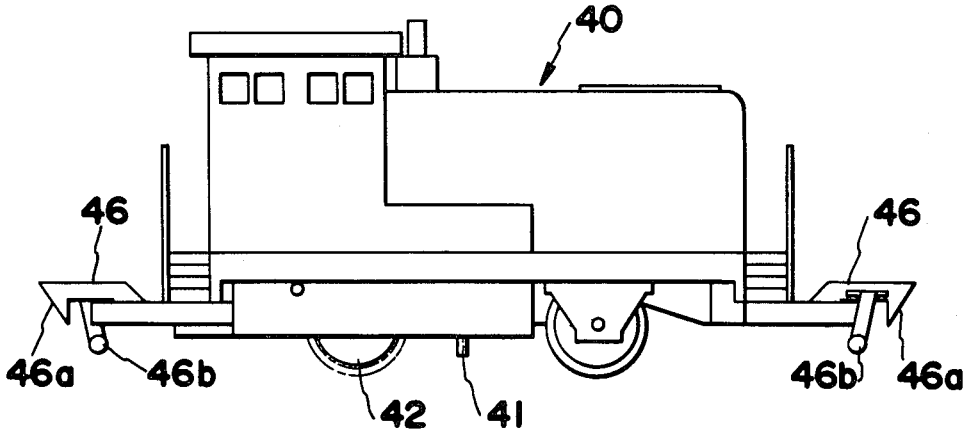
FIG. 7 illustrates a toy locomotive for use on the track of FIG. 1 in side elevation.
Figure 8:
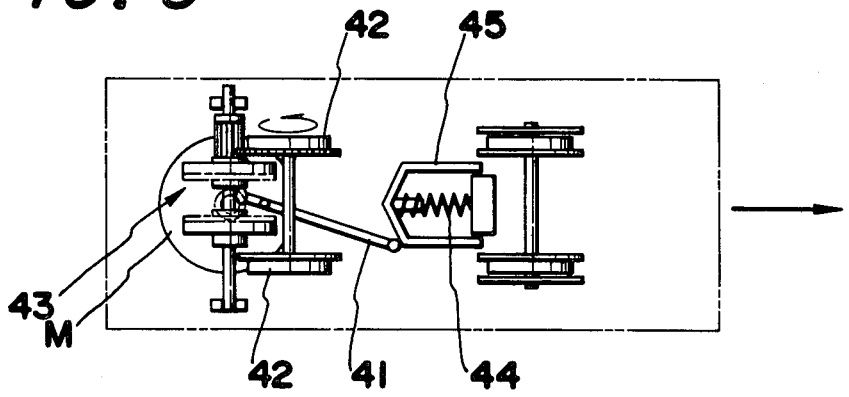
FIGS. 8 and 9 are bottom views of the locomotive of FIG. 7 in two different operating conditions.
Figure 9:
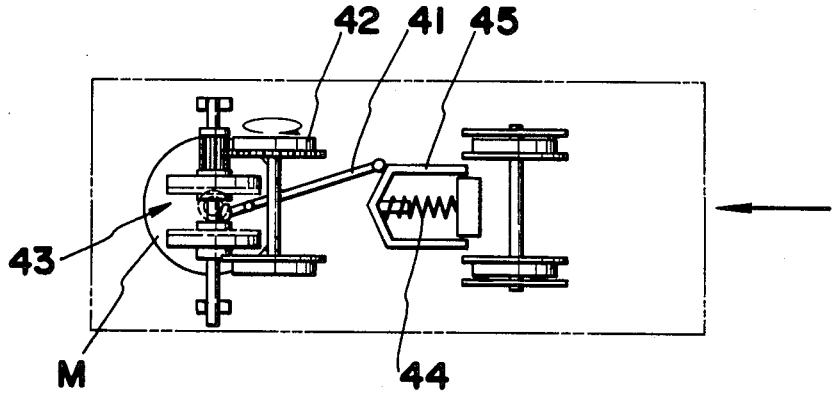

As is shown in FIGS. 7 to 9, the locomotive 40 of a toy train normally traveling on the tracks 1, 2 is equipped with a reversing lever 41 pivotally fastened to its bottom wall. A cam 45 movably mounted on the bottom wall, having a V-shaped face and backed by a spring 44 biases the lever 41 toward two alternative, angular positions shown in FIGS. 8 and 9 respectively.

The end of the longer lever arm is offset downward from the main portion of the arm for engagement by the suitably positioned rib 25 when the locomotive travels over the reversing device 3. The shorter arm of the pivoting lever 41 shifts a countershaft assembly 43 between positions of meshing engagement of two crown gears on the countershaft with the output shaft of an electric motor M of the locomotive, whereby wheels 42 of the locomotive are driven forward or backward by a pinion on the countershaft in accordance with the position of the lever 41.

Figure 12:
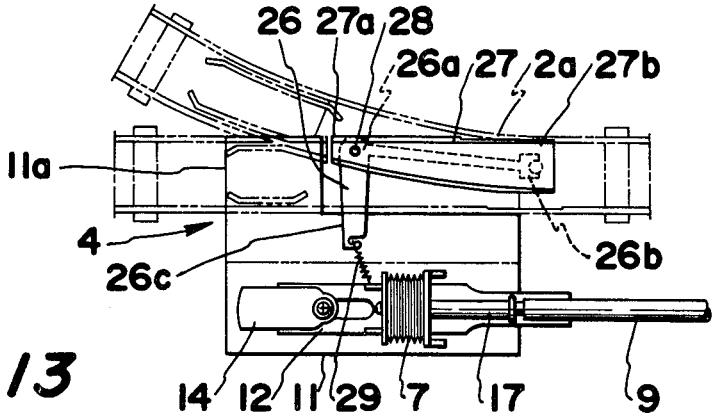
FIGS. 12 and 13 show a remotely controlled switch in the track of FIG. 1 in two different positions in plan view.
Figure 13:
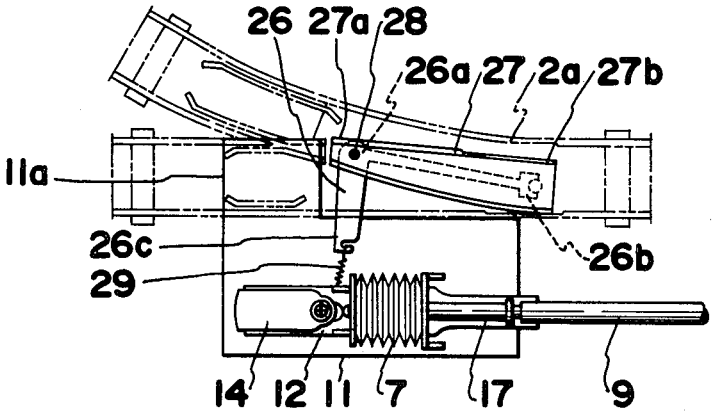

The switch 4, best seen in FIGS. 12 and 13, includes a movable toe section 27. One end 27*a* of the section 27 and of the pivot portion 26*a* of a bellcrank lever 26 are mounted on a pivot pin 28 projecting upward from a rail base plate 11*a*. The other end 27*b* of the section 27 is secured to one arm 26*b* of the lever 26. The other arm 26*c* of the lever 26 is coupled to the slide 12 of the associated actuator by a helical spring 29 so that the switch 4 directs a toy train to the side track 2 over a curved rail 2*a* when the lever 26 is in the position shown in FIG. 13, while permitting straight train movement on the main track 1 in the position of FIG. 12.

Figure 14:
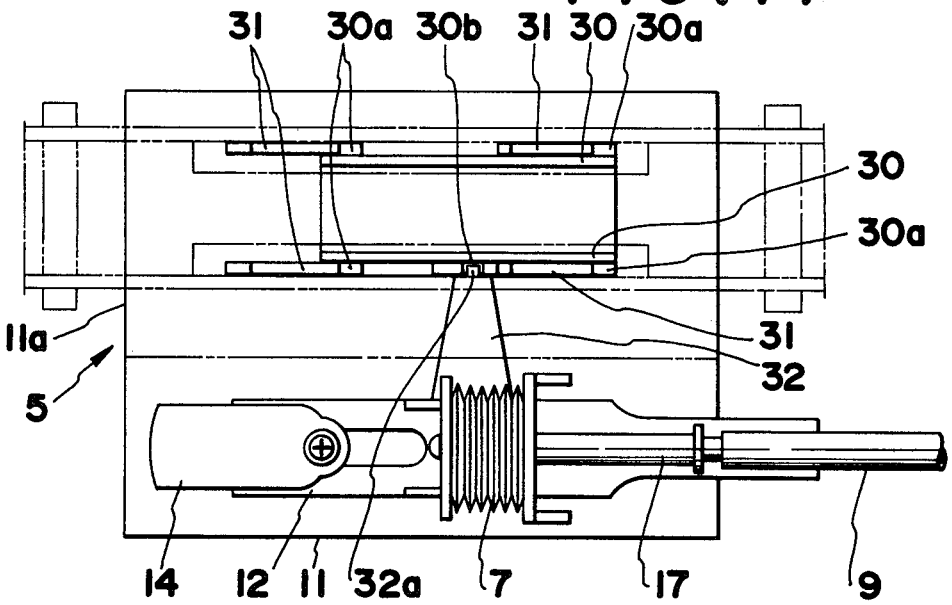
FIGS. 14 and 15 illustrate different operating conditions of an uncoupling device in the track of FIG. 1 in top plan view.
Figure 15:
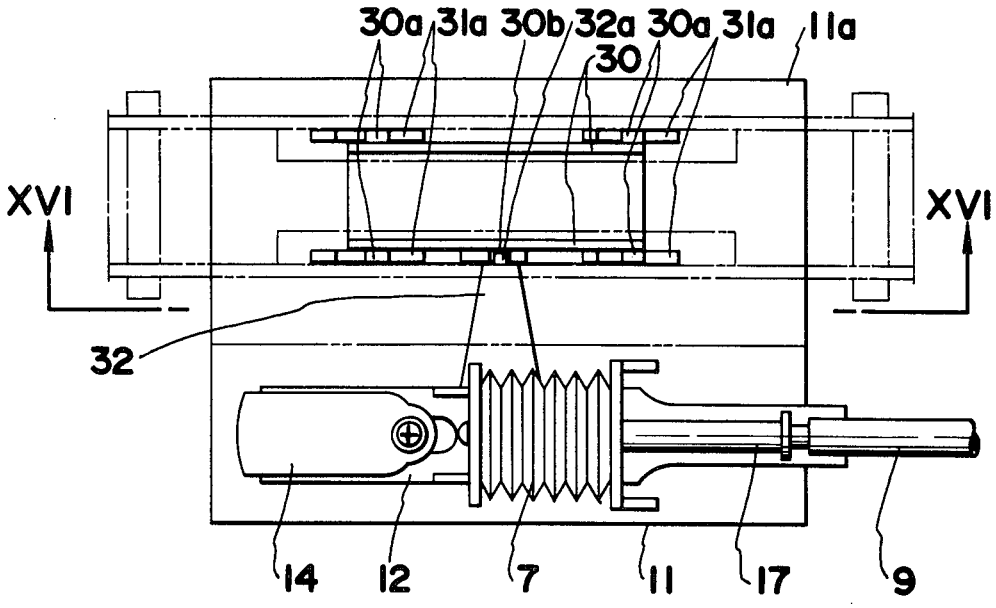
Figure 16:
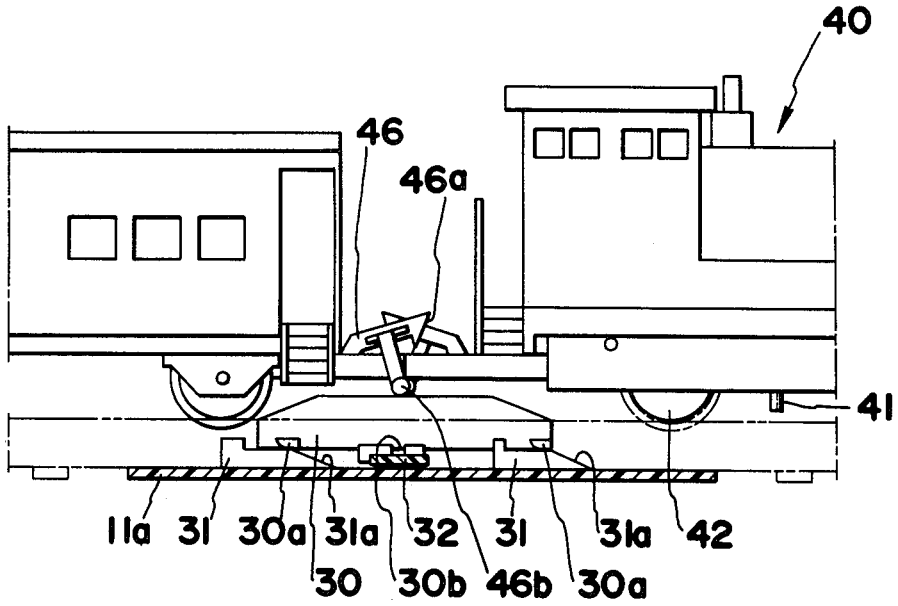
FIG. 16 shows the uncoupling device acting on a toy train in side elevation and partly in section on the line XVI—XVI in FIG. 15.

FIGS. 14 to 16 show the uncoupling device 5 in greater detail. It includes a shallow channel 30 whose web carries four external projections 30*a* adjacent the ends of the upturned channel flanges. Each projection 30*a* rests on a ramp 31 rising from a base plate 11*a* between the rails of a track section. The associated actuator has an arm 32 attached to the slide 12. The reduced, free end 32*a* of the arm 32 is received in a receptacle 30*b* on the channel 30. When the bellows 7 of the actuator expands and contracts, the arm 32 moves the channel 30 obliquely up and down the sloping faces 31*a* of the ramps 31 toward and away from the position seen in FIG. 16 in which the top edges of the flanges on the channel project upward beyond the rails.

The top edges slope downward near the front and rear ends of the channel 30 and cammingly cooperate with couplers 46 on the moving vehicles of a toy train when the channel 30 is in the raised position. As is seen in FIGS. 7 and 16, each coupler includes a pivotally mounted hook 46*a* and a cam follower 46*b* fixedly depending from the hook. Each cam follower 46*b* is positioned for engagement with the top edge of one of the flanges on the channel 30. Before the locomotive and car shown in FIG. 16 reached the uncoupling device, the coupler 46 of the locomotive was hooked into the car on one side of the train, and the coupler 46 of the car was hooked into the locomotive on the other side. When the train traveled over the raised channel 30, both hooks 46*a* were lifted out of engagement into the illustrated position in which they permit the car to be separated from the locomotive.

Other operating devices for modifying the run of a toy train on the tracks 1, 2 may be controlled by pneumatic controlling devices in the manner described with reference to the switch 4, reversing device 3, and uncoupling device 5. A stopping device and a signal may thus be jointly actuated by remote, pneumatic control for stopping a train near the signal.

As is shown in FIG. 1, portions of the hoses 9 between the control devices 6 and the actuators of the several operating devices are secured releasably to ties of the track 1 by means of clips 33, the hoses being held between projections 33*a* of the clips.

The layout of the toy railway system of the invention may be changed at will. The pneumatic controls for the several operating devices simplify assembly and disassembly of the track and avoid the hazards inherent in electrical controls.

What is claimed is:

1. A toy railway system comprising:

(a) a track including a plurality of rail sections adapted to carry moving toy railway vehicles;

(b) a plurality of operating means secured to respective rail sections for modifying the movement of vehicles moving thereon, each operating means including an operating member mounted for movement between two terminal positions;

(c) a plurality of actuating means operatively connected to respective operating members for moving the same;

(d) a plurality of control means respectively associated with said actuating means; and (e) a flexible, tubular member connecting each of said control means to the associated actuating means, (1) each control means including manually operable means for transmitting air to the associated actuating means through said tubular member, (2) each actuating means including moving means responsive to said transmitting for moving the associated operating member from one of said terminal positions thereof to the other terminal position, and arresting means for arresting said operating member in said other terminal position after said transmitting ceases.

2. A system as set forth in claim 1, wherein said operating means include a switch.

3. A system as set forth in claim 1, wherein said operating means include means for reversing the direction of movement of one of said vehicles.

4. A system as set forth in claim 1, wherein said operating means include uncoupling means for uncoupling one of said vehicles from another vehicle.

5. A system as set forth in claim 1, wherein each of said control means includes a housing and means on said housing releasably securing said housing to the housing of another control means.

6. A system as set forth in claim 1, wherein said moving means include bellows expanded by the transmitted air, each actuating means further including yieldably resilient means biasing said bellows for contracting and thereby returning the transmitted air to the associated control means.

7. A system as set forth in claim 6, wherein each of said actuating means further includes a slide member, guide means for guiding said slide member in a path between two terminal positions, means connecting said slide member to said bellows for movement between said terminal positions in response to the expanding and contracting of said bellows, and motion transmitting means drivingly connecting said slide member to a respective one of said operating means.

8. A system as set forth in claim 7, wherein said arresting means include cooperating cam means on said slide member and on said guide means respectively, said cam means including a heart-shaped cam track and a cam follower member movably engaging said tract.

9. A system as set forth in claim 7, wherein a portion of said slide member is accessible for manual movement of the slide member.

* * * * *